US007258479B1

(12) United States Patent
Westby

(10) Patent No.: US 7,258,479 B1
(45) Date of Patent: Aug. 21, 2007

(54) POWER-OPERATED SALT PELLET DECRYSTALIZING DEVICE

(76) Inventor: Marlyn Westby, 11515 E. Medina Ave., Mesa, AZ (US) 85212

( * ) Notice: Subject to any disclaimer, the term of this patent is extended or adjusted under 35 U.S.C. 154(b) by 321 days.

(21) Appl. No.: 10/984,656

(22) Filed: Nov. 10, 2004

(51) Int. Cl.
*B01F 7/20* (2006.01)

(52) U.S. Cl. ..... 366/129; 366/325.4; 366/343

(58) Field of Classification Search ..... 366/129, 366/325.3, 325.4, 343, 325.5
See application file for complete search history.

(56) References Cited

U.S. PATENT DOCUMENTS

| | | | | | |
|---|---|---|---|---|---|
| 264,781 | A * | 9/1882 | Silveus | 366/325.4 |
| 1,703,099 | A * | 2/1929 | Craddock | 366/282 |
| 2,235,604 | A * | 3/1941 | Brumagim | 366/325.4 |
| 3,166,303 | A * | 1/1965 | Chapman | 366/129 |
| 3,411,756 | A * | 11/1968 | Ziegler | 366/251 |
| 4,260,267 | A | 4/1981 | Walton | |
| 4,396,291 | A * | 8/1983 | Simmonds | 366/282 |
| 5,073,033 | A | 12/1991 | Klepeis | |
| 5,417,493 | A | 5/1995 | Ericson | |
| 5,676,463 | A | 10/1997 | Larsen | |
| 5,865,539 | A | 2/1999 | Rogers | |
| D419,414 | S | 1/2000 | Pellak | |
| 6,012,473 | A * | 1/2000 | Koyama | 134/149 |
| 6,520,672 | B1 * | 2/2003 | Whitney | 366/129 |

* cited by examiner

*Primary Examiner*—David Sorkin

(57) ABSTRACT

A power-operated salt pellet mixing device includes a hand-operable power tool provided with a first elongated shank. A second elongated shank is spaced from the first shank. The device further includes a coupling threadably attachable to the first shank and the second shank respectively such that the first and second shank can be rotated in sync. An agitator head is removably secured to the second shank and is rotatable in alternating directions. Such an agitator head is engageable with a salt bridge. The agitator head includes a central portion situated orthogonal to the second shank. A plurality of oppositely spaced flange portions are integral with the central portion and extend downwardly therefrom. Such flange portions are disposed orthogonal to the central portion and parallel to the second shank.

4 Claims, 2 Drawing Sheets

POWER-OPERATED SALT PELLET DECRYSTALIZING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to mixing devices and, more particularly, to a power operated salt pellet mixing device.

2. Prior Art

Domestic water softeners remove hardness from raw water by passing it through a tank containing a liquid treatment medium bed, typically formed of resin beads. A salt solution, that is brine, is passed through the resin bed to restore its softening capacity. The brine is formed in a container that is connected by a liquid flow passage to the tank containing the resin beads. The flow of liquid through the liquid flow passage is regulated by a control valve that is actuated by an electronic regeneration control circuit.

Salt, typically in the form of chunks or pellets, is placed in the container. Under the control of the electronic regeneration control circuit, the control valve allows a predetermined amount of water to enter the container. Provided enough salt is present, the water and salt form a saturated salt solution, or brine, which is the regenerant for the resin bed. Again, under the control of the electronic regeneration control circuit, the control valve is actuated to cause the brine to be withdrawn from the container and circulated through, and thereby regenerate, the resin in the tank.

The amount of salt remaining in the container is reduced each time a portion of the salt is dissolved to form a regenerant. The supply of salt will become exhausted after a number of regeneration cycles, unless additional salt is placed in the container. Such that the salt supply will not become exhausted, it is desirable to provide some type of alarm to indicate that the salt supply is close to being exhausted. Such an alarm may be formed as a part of the electronic regeneration control circuit.

When loosely compacted salt pellets or cube-style salt is used in a resin, it may form tiny crystals of evaporated salt, which are similar to table salt. These crystals may bond, creating a thick mass in the brine tank. This phenomenon, commonly known as 'mushing', may interrupt brine production. Brine production is the most important element for refreshing of the resin beads in a water softener. Without brine production, a water softener is not able produce soft water.

Accordingly, a need remains for a power-operable salt pellet mixing device to break masses of salt crystals formed in salt tanks and overcome the above-noted shortcomings. The present invention satisfies such a need by providing a tool for breaking up crystallized salt in water softeners. Such a tool would be small in size, convenient, efficient and simple to use and includes a drill for easy and powerful operation.

BRIEF SUMMARY OF THE INVENTION

In view of the foregoing background, it is therefore an object of the present invention to provide a power-operable salt pellet mixing device. These and other objects, features, and advantages of the invention are provided by a device for penetrating through a salt bridge formed within a water-softening storage tank. Such a device includes a hand-operable power tool provided with a chuck and a first elongated shank having proximal and distal end portions removably securable to the chuck and axially positioned away therefrom respectively. The distal end portion has a threaded outer surface. A second elongated shank is spaced from the first shank and has proximal and distal end portions axially aligned with the first shank respectively. The proximal and distal end portions of the second shank each have a threaded outer surface.

The device further includes a coupling having a hollow threaded core and axially opposed end portions threadably attachable to the distal end portion of the first shank and the proximal end portion of the second shank respectively such that the first and second shank can be rotated in sync during operating conditions. An agitator head is removably secured to the distal end portion of the second shank and is rotatable in alternating directions. Such an agitator head is engageable with the salt bridge for causing salt particulates to separate and scatter from a humidified solid state.

The device preferably further includes a pair of nuts and a pair of washers sandwiched therebetween respectively. The nuts are threadably secured to the distal end portion of the second shank wherein the nuts are oppositely spaced above and below the agitator head and axially aligned with the first and second shanks.

The agitator head preferably includes a central portion situated orthogonal to the second shank and extending outwardly therefrom along a linear plane. A plurality of oppositely spaced flange portions are integral with the central portion and preferably extend downwardly therefrom along linear paths respectively. Such flange portions are disposed orthogonal to the central portion and parallel to the second shank.

The central portion preferably has a longitudinal length greater than a longitudinal length of each of the flange portions. The longitudinal lengths of the flange portions are equal for providing a balanced rotational movement about the second shank. Such flange portions preferably have arcuate bottom end portions provided with equal radii for reducing the likelihood of damaging the salt tank.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, this embodiment is provided so that this application will be thorough and complete, and will fully convey the true scope of the invention to those skilled in the art. Like numbers refer to like elements throughout the figures.

Figure 1:
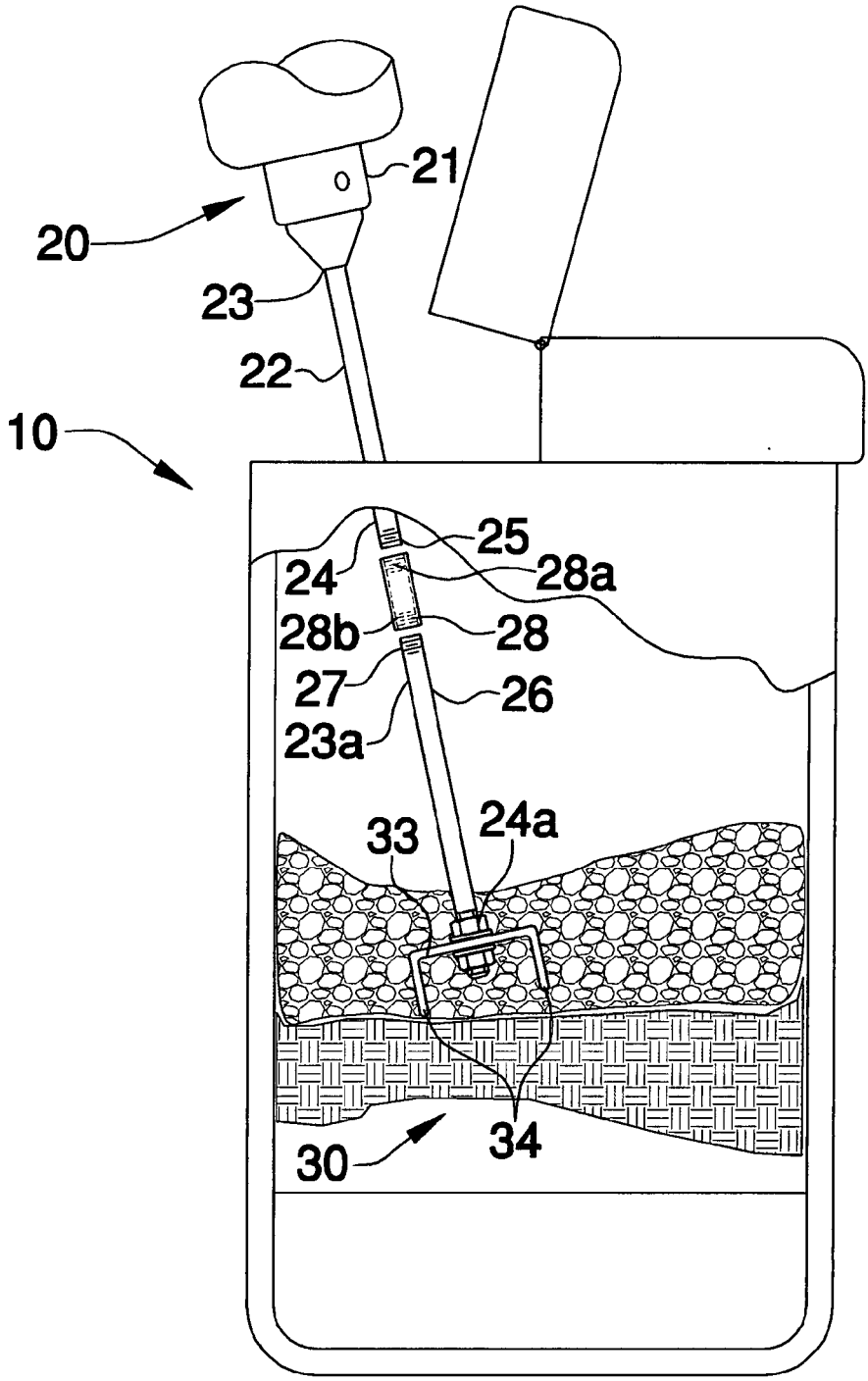
FIG. 1 is a partial cross-sectional view showing the power tool in a preferred environment, in accordance with the present invention.
Figure 2:
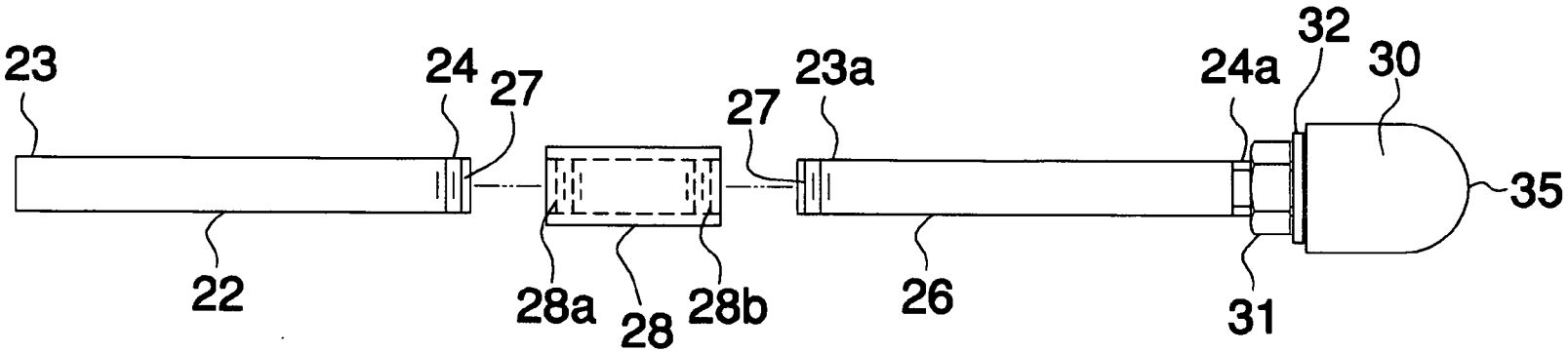
FIG. 2 is a side elevational view showing the coupling being threadably attachable to the first and second shanks.
Figure 3:
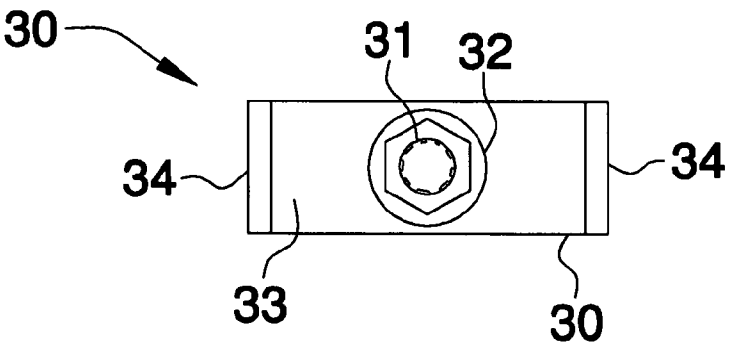
FIG. 3 is a front elevational view showing a nut and washer securing the agitator head to the second shank.

The device of this invention is referred to generally in FIGS. 1-3 by the reference numeral 10 and is intended to provide a power-operable salt pellet mixing device. It should be understood that the device 10 may be used to mix and break-up many different types of organic substances and should not be limited to only salt pellets. These and other objects, features, and advantages of the invention are provided by a device 10 for penetrating through a salt bridge formed within a water-softening storage tank.

Initially referring to FIG. 1, such a device 10 includes a hand-operable power tool 20 provided with a chuck 21 and a first elongated shank 22 having proximal 23 and distal 24 end portions removably securable to the chuck 21 and axially positioned away therefrom respectively. Such a power tool 20 enables a user to easily break up masses of crystallized salt without having to bend over the tank, thus straining or overexerting themselves. The distal end portion 24 has a threaded outer surface 25.

A second elongated shank 26 is spaced from the first shank 22 and has proximal 23A and distal 24A end portions axially aligned with the first shank 22 respectively. The proximal 23A and distal 24A end portions of the second shank 26 each have a threaded outer surface 27 for being easily attached to the coupling 28 (described herein below). The shanks 22, 26 are preferably formed from steel and aluminum for their strength and durability, but may, of course, be formed from other durable metals. Of course, a single elongated shank may be used in place of the shanks 22, 26 as well known in the industry, however, the use of shanks 22, 26 enables a manufacturer to package and ship the device 10 in a smaller package, thus saving packaging costs and oversize shipping costs.

Referring to FIG. 2, the device 10 further includes a coupling 28 having a hollow threaded core and axially opposed end portions 28A, 28B threadably attachable to the distal end portion 24 of the first shank 22 and the proximal end portion 23A of the second shank 26 respectively such that the first 22 and second 26 shank can be rotated in sync during operating conditions. Such a coupling 28 enables the drill 20 to rotate the agitator head 3Q (described herein below) so that masses of crystallized salt are easily broken up with little effort. An agitator head 30 is removably secured to the distal end portion 24A of the second shank 26 and is rotatable in alternating directions. Such an agitator head 30 is engageable with the salt bridge for causing salt particulates to separate and scatter from a humidified solid state.

Referring to FIG. 3, the device 10 further preferably includes a pair of nuts 31 and a pair of washers 32 sandwiched therebetween respectively. The nuts 31 are threadably secured to the distal end portion 24A of the second shank 26 wherein the nuts 31 are oppositely spaced above and below the agitator head 30 and axially aligned with the first 22 and second 26 shanks. Advantageously, this allows a user to quickly and easily change the agitator head 30 should such a need arise.

Referring to FIGS. 1 and 2, the agitator head 30 preferably includes a central portion 33 situated orthogonal to the second shank 26 and extending outwardly therefrom along a linear plane. A plurality of oppositely spaced flange portions 34 are integral with the central portion 33 and preferably extend downwardly therefrom along linear paths respectively, as best shown in FIG. 1. Such flange portions 34 are disposed orthogonal to the central portion 33 and parallel to the second shank 26. Advantageously, the flange portions 34 are effective at breaking up clumps of salt particulates so that "mushing" is kept to a minimum within the tank.

The central portion 33 has a longitudinal length greater than a longitudinal length of each of the flange portions 34. The longitudinal lengths of the flange portions 34 are equal for providing a balanced rotational movement about the second shank 26. Such flange portions 34 preferably have arcuate bottom end portions 35 provided with equal radii for reducing the likelihood of damaging the salt tank, as best shown in FIG. 2. Damage to the tank could result in water leakage, thus rendering the tank inoperable.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for penetrating through a salt bridge formed within a water-softening storage tank, said device comprising:

a hand-operable power tool provided with a chuck;

a first elongated shank having proximal and distal end portions removably securable to the chuck and axially positioned away therefrom respectively, said distal end portion having a threaded outer surface;

a second elongated shank spaced from said first shank and having proximal and distal end portions axially aligned with said first shank respectively, said proximal and distal end portions of said second shank each having a threaded outer surface;

a coupling having a hollow threaded core and axially opposed end portions threadably attachable to said distal end portion of said first shank and said proximal end portion of said second shank respectively such that said first and second shank can be rotated in sync during operating conditions; and an agitator head removably secured to said distal end portion of said second shank and being rotatable in alternating directions, said agitator head being engageable with the salt bridge for causing salt particulates to separate and scatter from a humidified solid state, wherein said agitator head comprises a central portion situated orthogonal to said second shank and extending outwardly therefrom along a plane, said central portion having a rectangular shape provided with first and second longitudinal sides extending parallel to a longitudinal length of said central portion, said central portion further having first and second ends oriented perpendicular to said first and second longitudinal sides respectively; and a plurality of oppositely spaced flange portions integral with said central portion and extending downwardly therefrom along linear paths respectively, said flange portions being disposed orthogonal to said central portion and parallel to said second shank;

wherein said flange portions have arcuate bottom end portions provided with equal radii for reducing the likelihood of damaging the salt tank, each of said flange portions further having a diameter equal to a length of said first and second ends respectively, each of said flange portions further having planar inner and outer surfaces respectively.

2. The device of claim 1, further comprising:

a pair of nuts and a pair of washers sandwiched therebetween respectively, said nuts being threadably secured to said distal end portion of said second shank wherein said nuts are oppositely spaced above and below said agitator head and axially aligned with said first and second shanks.

3. The device of claim 1, wherein said flange portions are oppositely spaced along said central portion and positioned equidistantly from said second shank.

4. The device of claim 1, wherein said central portion has a longitudinal length greater than a longitudinal length of each said flange portions, the longitudinal lengths of said flange portions being equal for providing a balanced rotational movement about said second shank.

* * * * *